US009136642B1

(12) United States Patent
Lin et al.

(10) Patent No.: US 9,136,642 B1
(45) Date of Patent: Sep. 15, 2015

(54) ACCESSORY FOR ELECTRICALLY CONNECTING AN AUDIO OUTPUT DEVICE TO A PORTABLE ELECTRONIC DEVICE

(71) Applicants: Gloriole Electroptic Technology Corp., Kaohsiung (TW); SHEN ZHEN WONDERWIN TECHNOLOGY CO., LTD., Shen Zhen, Guang Dong Province (CN); TASIN TECHNOLOGY CO., LTD., Guangdong (CN)

(72) Inventors: Jim Lin, Kaohsiung (TW); Danxu Wu, Guangdong (CN)

(73) Assignees: Gloriole Electroptic Technology Corp., Kaohsiung (TW); Shen Zhen Wonderwin Technology Co., Ltd., Shen Zhen, Guang Dong Province (CN); Tasin Technology Co., Ltd., Guangdong (CN)

( * ) Notice: Subject to any disclaimer, the term of this patent is extended or adjusted under 35 U.S.C. 154(b) by 0 days.

(21) Appl. No.: 14/298,044

(22) Filed: Jun. 6, 2014

(30) Foreign Application Priority Data

Mar. 20, 2014 (TW) ..... 103204765 U

(51) Int. Cl.

| | |
|---|---|
| ***H01R 39/00*** | (2006.01) |
| ***H01R 13/62*** | (2006.01) |
| ***H01R 31/06*** | (2006.01) |
| ***H01R 24/58*** | (2011.01) |

(52) U.S. Cl.
CPC ..... *H01R 13/6205* (2013.01); *H01R 24/58* (2013.01); *H01R 31/06* (2013.01)

(58) Field of Classification Search
CPC ..... H01R 13/6205
See application file for complete search history.

(56) References Cited

U.S. PATENT DOCUMENTS

| | | | | |
|---|---|---|---|---|
| 2005/0208783 | A1* | 9/2005 | Suzuki et al. | 439/42 |
| 2005/0215111 | A1* | 9/2005 | Weikel et al. | 439/502 |
| 2007/0015537 | A1* | 1/2007 | DeBiasio et al. | 455/556.1 |
| 2007/0178771 | A1* | 8/2007 | Goetz et al. | 439/669 |
| 2007/0254510 | A1* | 11/2007 | DeBey | 439/188 |
| 2008/0096413 | A1* | 4/2008 | Chen | 439/345 |
| 2008/0236866 | A1* | 10/2008 | Kim et al. | 174/113 R |
| 2009/0011652 | A1* | 1/2009 | Koh | 439/638 |
| 2009/0081898 | A1* | 3/2009 | Jeong et al. | 439/304 |
| 2010/0029096 | A1* | 2/2010 | Wu | 439/31 |
| 2010/0123006 | A1* | 5/2010 | Chen | 235/441 |
| 2012/0200173 | A1* | 8/2012 | Liu et al. | 307/116 |
| 2013/0020425 | A1* | 1/2013 | Grassi et al. | 242/388 |

* cited by examiner

*Primary Examiner* — James Harvey
(74) *Attorney, Agent, or Firm* — Muncy, Geissler, Olds & Lowe, P.C.

(57) ABSTRACT

An accessory is for electrically connecting an audio output device to a portable electronic device. The accessory includes an attachment unit, a connector jack and a coupling unit. The attachment unit is to be removably attached to the portable electronic device. The connector jack is for mating electrical connection with an audio socket of the portable electronic device. The coupling unit is for mating electrical connection with the audio output device, and is to be removably attached to the attachment unit for establishing electrical connection with the attachment unit. The attachment unit and the coupling unit are configured to removably engage each other by magnetic attraction.

5 Claims, 3 Drawing Sheets

ACCESSORY FOR ELECTRICALLY CONNECTING AN AUDIO OUTPUT DEVICE TO A PORTABLE ELECTRONIC DEVICE

CROSS-REFERENCE TO RELATED APPLICATION

This application claims priority of Taiwanese Application No. 103204765, filed on Mar. 20, 2014.

BACKGROUND OF THE INVENTION

1. Field of the Invention

The invention relates to an accessory for a portable electronic device, more particularly to an accessory for connecting an audio output device to a portable electronic device.

2. Description of the Related Art

It is now almost customary for a conventional portable electronic device (e.g., a mobile phone) to have an audio socket that allows an audio output device (e.g., an earphone) to be connected to the conventional portable electronic device by plugging an audio jack of the audio output device into the audio socket.

However, the audio socket may be damaged after repeated plugging and unplugging actions. Additionally, when the audio jack is unplugged, the audio socket is left uncovered. This may result in entry of undesired matters (e.g., liquid, dust, etc.) into the audio socket, possibly arising in more damage to the conventional portable electronic device.

SUMMARY OF THE INVENTION

Therefore, the object of the present invention is to provide an accessory that may eliminate the need for frequent plugging and unplugging of an audio jack with respect to an audio socket of a portable electrical device and that provides protection to the audio socket even when no audio output device is connected to the portable electronic device.

Accordingly, an accessory of the present invention is for electrically connecting an audio output device to a portable electronic device. The portable electronic device has an audio socket, and the audio output device has an audio jack. The accessory comprises an attachment unit, a connector jack and a coupling unit.

The attachment unit is configured to be removably attached to the portable electronic device, and includes a first connecting component.

The connector jack is connected electrically to the first connecting component, and is configured for mating electrical connection with the audio socket of the portable electronic device.

The coupling unit includes an audio port configured for mating electrical connection with the audio jack of the audio output device, and a second connecting component connected electrically to the audio port, removably engaged to the first connecting component to removably attach the coupling unit to the attachment unit, and configured to establish electrical connection with the first connecting component when the coupling unit is attached to the attachment unit via engagement between the first connecting component and the second connecting component.

The first connecting component and the second connecting component are configured to removably engage each other by magnetic attraction.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
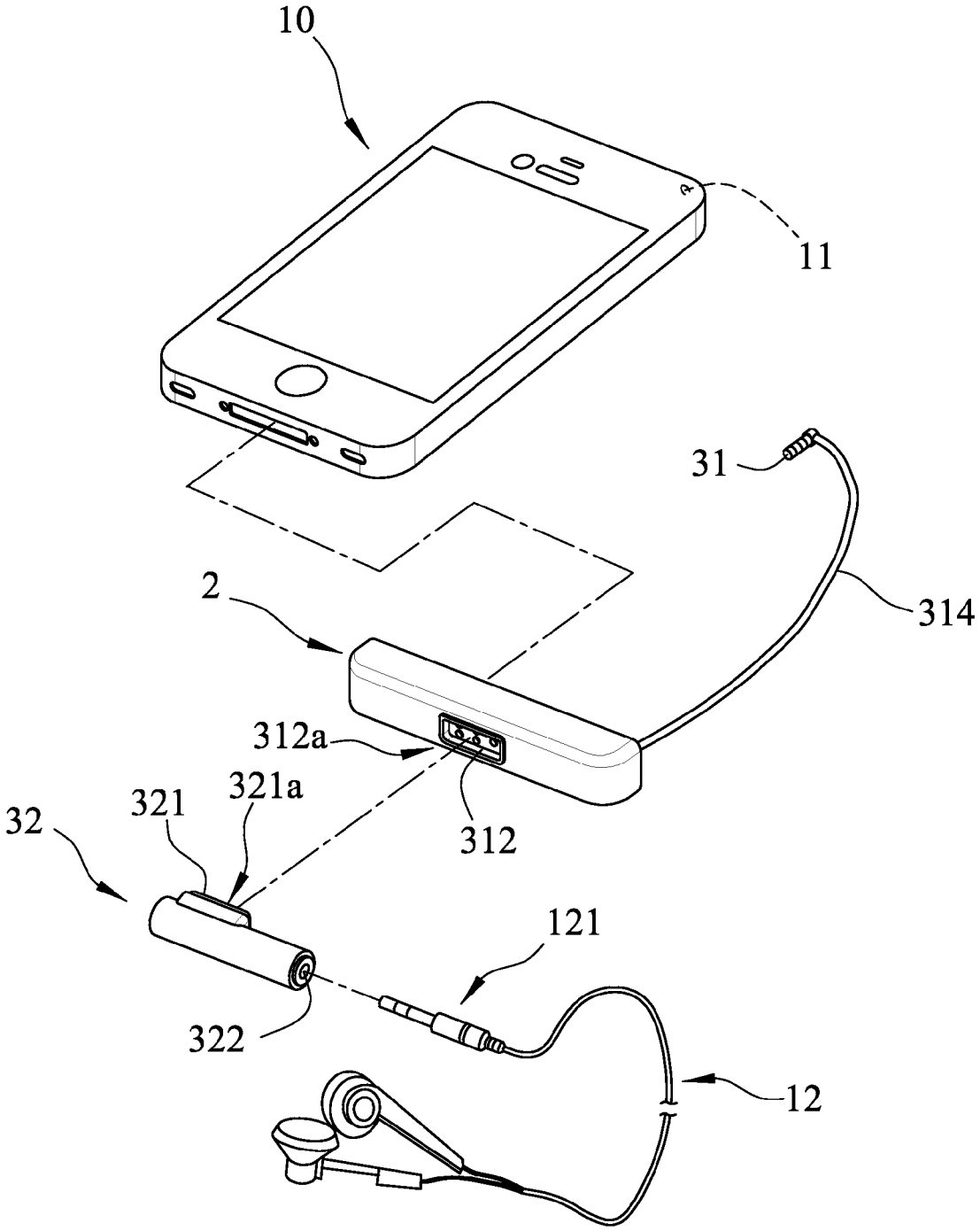
FIG. 1 is an exploded perspective view of the preferred embodiment of an accessory according to the invention.

As shown in FIG. 1, the preferred embodiment of an accessory according to the present invention is for electrically connecting an audio output device 12 to a portable electronic device 10. In this embodiment, the portable electronic device 10 is a conventional mobile phone that has an audio socket 11. The audio output device 12 may be embodied using a headphone, earbuds or an in-ear headphone, and has an audio jack 121.

The accessory comprises an attachment unit 2, a connector jack 31, a coupling unit 32 and an electrical cord 314.

The attachment unit 2 is configured to be removably attached to the portable electronic device 10, and includes a first connecting component 312. In this embodiment, the attachment unit 2 is configured to be sleeved fittingly and removably on a side portion of the portable electronic device 10. Preferably, the side portion of the portable electronic device 10 is disposed opposite to the side portion with the audio socket 11.

Figure 2:
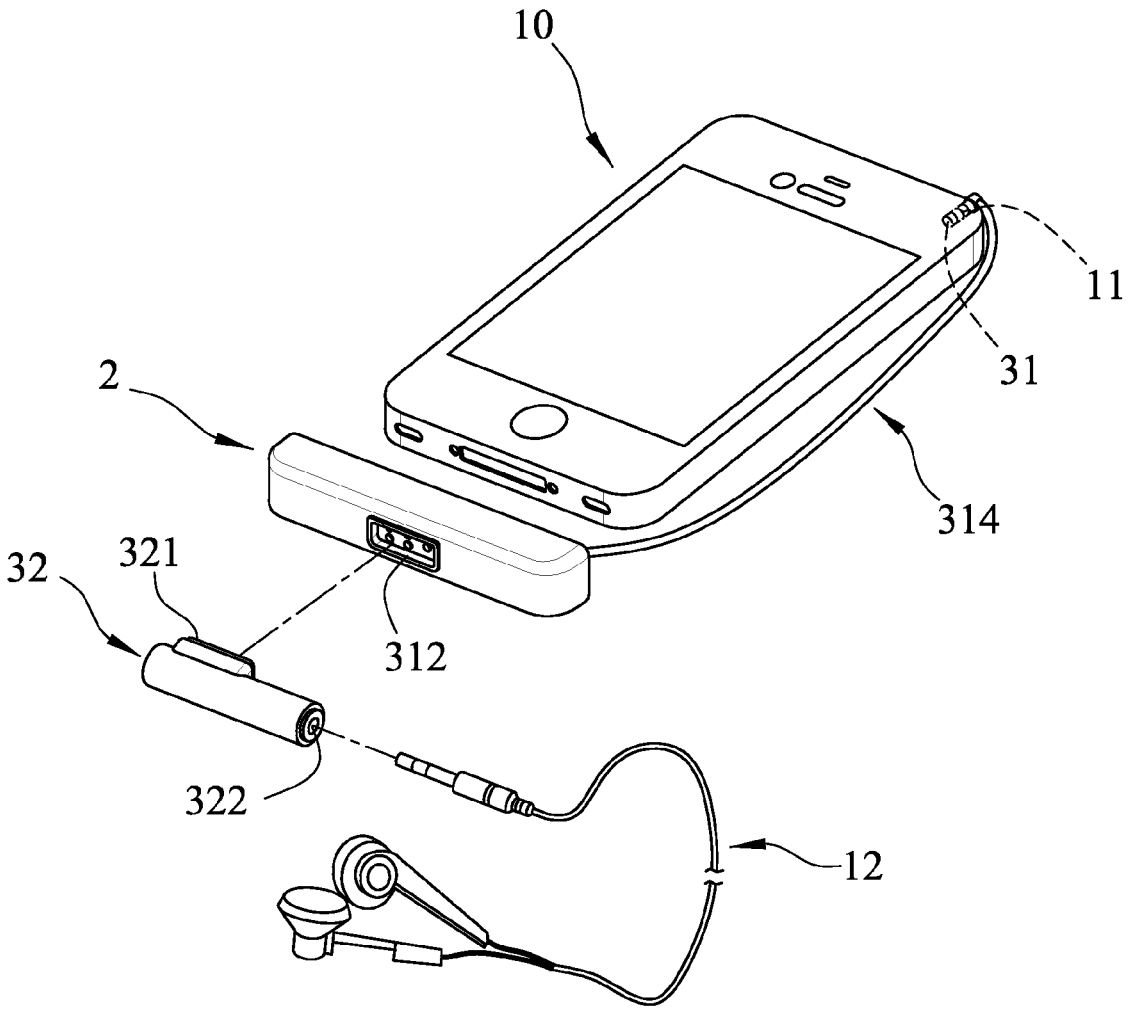
FIG. 2 is an exploded perspective view illustrating a connector jack of the preferred embodiment plugged into an audio socket of a portable electronic device.

The electrical cord 314 extends between the connector jack 31 and the attachment unit 2 to electrically interconnect the connector jack 31 and the first connecting component 312. The connector jack 31 is configured for mating electrical connection with the audio socket 11 of the portable electronic device 10 (See FIG. 2).

The coupling unit 32 includes a second connecting component 321 and an audio port 322. The audio port 322 is configured for mating electrical connection with the audio jack 121 of the audio output device 12. The second connecting component 321 is connected electrically to the audio port 322, and is removably engaged to the first connecting component 312.

In this embodiment, the first connecting component 312 is configured as a groove, and the second connecting component 321 is configured as a block to engage the groove. The first connecting component 312 and the second connecting component 321 include a magnetic material, and are configured to removably engage each other by magnetic attraction. Therefore, it is possible to removably attach the coupling unit 32 to the attachment unit 2 using the first connecting component 312 and the second connecting component 321.

Furthermore, the second connecting component 321 is configured to establish electrical connection with the first connecting component 312 when the coupling unit 32 is attached to the attachment unit 2 via engagement between the first connecting component 312 and the second connecting component 321. This can be achieved by providing electrical contacts on the first connecting component 312 and the second connecting component 321. Specifically, the first connecting component 312 is provided with a first electrical contact set 312*a* that is connected electrically to the connector jack 31, and the second connecting component 321 is provided with a second electrical contact set 321*a* that is connected electrically to the audio port 322. The first electrical contact set 312*a* and the second electrical contact set 321*a* are configured to establish electrical connection therebetween when the coupling unit 32 is attached to the attachment unit 2 via engagement between the first connecting component 312 and the second connecting component 321.

Figure 3:
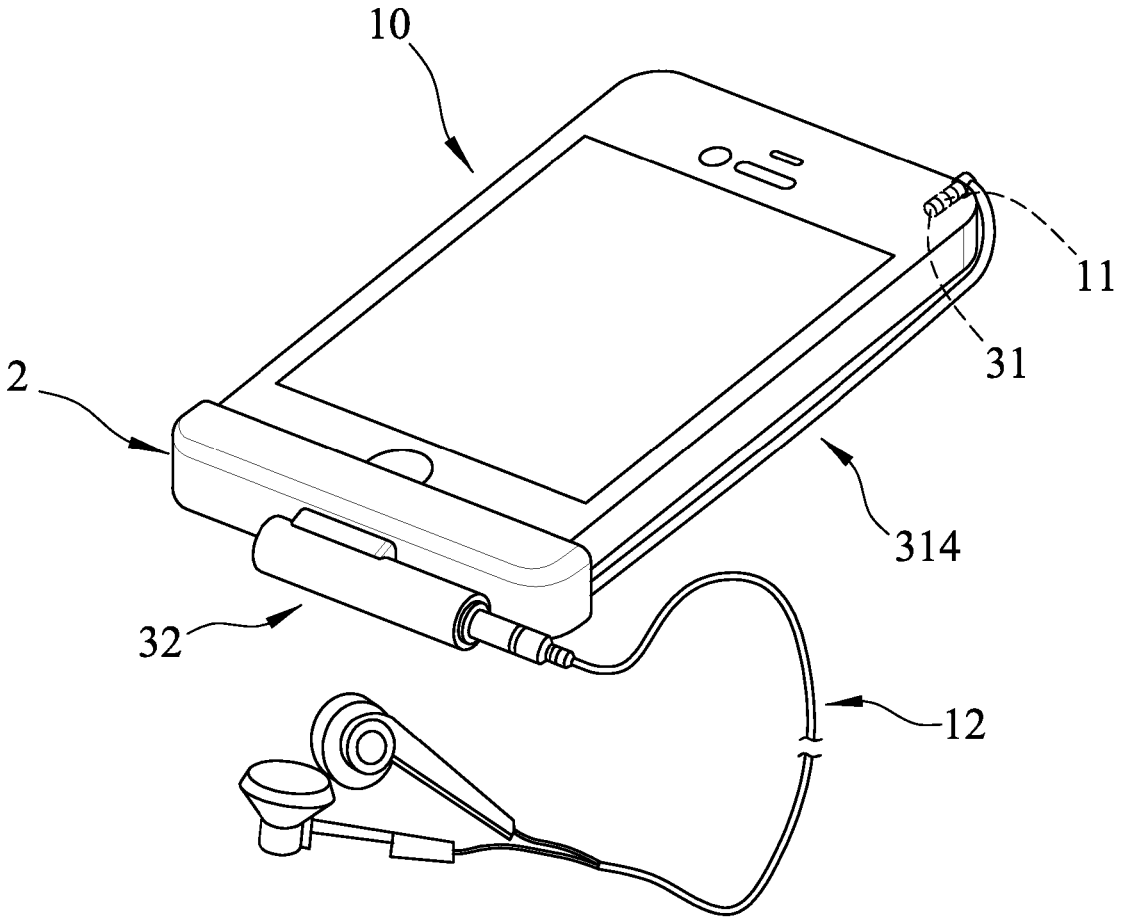
FIG. 3 illustrates the preferred embodiment attached to the portable electronic device for establishing an electrical connection between the portable electronic device and an audio output device.

Referring to FIG. 3, to utilize the accessory of this embodiment, the connector jack 31 is first plugged into the audio socket 11 of the portable electronic device 10. The attachment unit 2 is then, optionally, sleeved onto the side portion of the portable electronic device 10.

Afterward, an electrical connection may be established between the portable electronic device 10 and the audio output device 12 by coupling the audio jack 121 of the audio output device 12 via the accessory of this embodiment to the audio port 322 of the coupling unit 32, followed by coupling the second connecting component 321 to the first connecting component 312.

It is noted that the steps of using the accessory are not required to be carried out in the exact order as described above.

On the other hand, when it is desired to disconnect the audio output device 12, the second connecting component 321 is pulled away from the first connecting component 312 (using a force larger than the magnetic attraction force therebetween). Alternatively, the audio jack 121 can be simply unplugged from the audio port 322.

To sum up, the accessory of the present invention allows the audio output device 12 to be connected and disconnected with respect to the portable electronic device 10 without requiring frequent plugging and unplugging of the connector jack 31 with respect to the audio socket 11. As such, possible damage to the audio socket 11 attributed to frequent plugging and unplugging may be prevented. Moreover, it is possible to leave the connector jack 31 in a connected state with respect to the audio socket 11, so as to prevent entry of foreign substances into the audio socket 11.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An accessory for electrically connecting an audio output device to a portable electronic device, the portable electronic device having an audio socket, the audio output device having an audio jack, said accessory comprising:

an attachment unit that is configured to be removably attached to the portable electronic device, and that includes a first connecting component;

a connector jack that is connected electrically to said first connecting component and that is configured for mating electrical connection with the audio socket of the portable electronic device; and a coupling unit that includes an audio port configured for mating electrical connection with the audio jack of the audio output device, and a second connecting component connected electrically to said audio port, removably engaged to said first connecting component to removably attach said coupling unit to said attachment unit, and configured to establish electrical connection with said first connecting component when said coupling unit is attached to said attachment unit via engagement between said first connecting component and said second connecting component;

wherein said first connecting component and said second connecting component are configured to removably engage each other by magnetic attraction.

2. The accessory of claim 1, wherein said attachment unit is configured to be sleeved fittingly and removably on a side portion of the portable electronic device.

3. The accessory of claim 1, further comprising an electrical cord that extends between said connector jack and said attachment unit to electrically interconnect said connector jack and said first connecting component.

4. The accessory of claim 1, wherein said first connecting component is provided with a first electrical contact set that is connected electrically to said connector jack, said second connecting component is provided with a second electrical contact set that is connected electrically to said audio port, and said first electrical contact set and said second electrical contact set are configured to establish electrical connection therebetween when said coupling unit is attached to said attachment unit via engagement between said first connecting component and said second connecting component.

5. The accessory of claim 1, wherein one of said first connecting component and said second connecting component is configured as a groove, and the other one of said first connecting component and said second connecting component is configured as a block to engage said groove.

* * * * *